US009295907B2

(12) United States Patent
Richter et al.

(10) Patent No.: US 9,295,907 B2
(45) Date of Patent: Mar. 29, 2016

(54) GAMING APPARATUS AND METHOD INCLUDING A GAME BOARD, A PLAYING ELEMENT AND CIRCUITRY FOR DETERMINING THE ORIENTATION OF THE PLAYING ELEMENT BASED ON CLOCK PULSES AND FOR CAUSING A LIGHT SOURCE OF THE PLAYING ELEMENT TO RESPOND TO PLAYER INTERACTION

(71) Applicant: R2Z Innovations, Inc., Vancouver (CA)

(72) Inventors: Wolfgang Richter, NW (DE); Faranak Zadeh, Vancouver (CA)

( * ) Notice: Subject to any disclaimer, the term of this patent is extended or adjusted under 35 U.S.C. 154(b) by 304 days.

(21) Appl. No.: 14/183,540

(22) Filed: Feb. 19, 2014

(65) Prior Publication Data

US 2015/0231487 A1 Aug. 20, 2015

(51) Int. Cl.
*A63F 9/04* (2006.01)
*A63F 3/00* (2006.01)

(52) U.S. Cl.
CPC ..... *A63F 9/0468* (2013.01); *A63F 3/00643* (2013.01); *A63F 2003/00652* (2013.01); *A63F 2003/00662* (2013.01); *A63F 2250/265* (2013.01)

(58) Field of Classification Search
None
See application file for complete search history.

(56) References Cited

U.S. PATENT DOCUMENTS

2012/0112828 A1* 5/2012 Richter ..... H02J 17/00 327/564
2012/0295684 A1* 11/2012 Richter ..... A63F 3/00643 463/16

OTHER PUBLICATIONS

Electronic Board Game Creator, [retrieved on Feb. 9, 2016],Retrieved from the USPTO Database Patent Application Retrieval using Internet <URL: http://portal.uspto.gov/pair/PublicPair> using U.S. Appl. No. 13/174,584. This document was publically available as of Nov. 22, 2012 based on the publication date of U.S. Appl. No. 13/174,584.*

* cited by examiner

*Primary Examiner* — Milap Shah
*Assistant Examiner* — Robert T Clarke, Jr.

(57) ABSTRACT

A gaming apparatus for interacting with at least one player for playing a game is provided. The gaming apparatus includes a gaming surface and a playing item interacts with the gaming surface through the capacitive coupling. The gaming surface receives power from a battery source and includes a generator for generating AC power, a conducting surface generates alternating electric field, a converter for converting AC power into DC power and a computing element for storing the game instructions. The playing item includes a non-conductive casing positioned on the conducting surface, one or more electrodes connected to at least each side of the non-conductive casing for coupling the electric field with the conducting surface, one or more pulse generators to generate orientation of each surface, a first logic circuit for receiving information of the surface and a second logic circuit sends the information to the converter for decoding and further to the computing element and the computing element further controls the LED based on the orientation of the surface of the playing element.

7 Claims, 5 Drawing Sheets

GAMING APPARATUS AND METHOD INCLUDING A GAME BOARD, A PLAYING ELEMENT AND CIRCUITRY FOR DETERMINING THE ORIENTATION OF THE PLAYING ELEMENT BASED ON CLOCK PULSES AND FOR CAUSING A LIGHT SOURCE OF THE PLAYING ELEMENT TO RESPOND TO PLAYER INTERACTION

BACKGROUND OF THE INVENTION

1. Field of the Invention

The present invention generally relates to an interactive electronic apparatus for playing a game and more particularly relates to an interactive gaming apparatus for dynamic interaction with the player in a gaming environment.

2. Description of Related Art

Various types of gaming devices have been constructed with the aim of captivating the players and perpetuating their interest in the game. Within the present context, a board game is a game in which pieces are placed, moved or removed from a surface according to a predefined set of rules and conditions. Board games are mostly based on strategy, luck, IQ, EQ, logical thinking a skill, a board game is primarily checks the mental powers of the player.

Almost all of these games have presently been digitized by the development of various mobile and computer applications, substituting the conventional board and piece format. Such games do not involve latest technologies in upgrading the conventional board games. The board games have now become obsolete and a bit too old fashioned for the present tech-savvy generation. The complete digitization of board games presents the problem of isolating the older players of the game as well as removing the basic elements of touch and visualization of the original game board and pieces.

However such devices and gaming methods heavily rely on sensors. These sensors are highly susceptible to damage. This may lead to various repair and maintenance problems. Therefore, there is a need of method and a gaming apparatus for interacting with at least one player for playing a game under the influence of electric field.

SUMMARY OF THE INVENTION

In accordance with a preferred embodiment of the present invention, a gaming apparatus for interacting with at least one player for playing a game is provided.

An object of the present invention is to provide a gaming apparatus with a gaming surface and at least one playing element interacting with at least one player and the gaming surface. The gaming surface includes a generator receiving power from DC source for generating AC power of fixed frequency; a conducting surface receives the AC power generated from the generator for generating an alternating electric field; a converter coupling with said conducting surface and said converter accepts AC power from said generator for generating a DC power; a computing element utilizing the DC power supplied by said converter and the frequency supplied by said generator, said computing element further storing the instruction set of the game.

The playing element includes a non-conductive casing placed on the conducting surface; one or more electrodes attached to each surface of said non-conductive casing receives alternating electric field from said conducting surface for transferring the AC power; at least one of one or more pulse generators connected to at least one of the one or more electrodes for receiving the AC power for generating clock pulses to define the orientation of each surface of said non-conductive casing.

The playing element further includes a first logic circuit connected to one or more pulse generators for receiving the information related to the orientation of each surface of the non-conductive surface and further releases a first signal; a second logic circuit transmit the first signal received from the first logic circuit to the computing element for releasing a second signal.

The playing element further includes one or more light sources connected to each of the one or more electrodes for receiving AC power and further responding on interaction with at least one player and furthermore responding on the second signal generated by the computing element via the second logic circuit; and rectifiers to convert the AC power into DC power in order to operate the pulse generators, the logic circuits and the light sources.

Broadly stated the embodiments of the invention are directed to a method and a gaming apparatus used to play different board games in an innovative manner. The product includes a gaming board as well as a gaming element, and a method for the game board to sense and display which of the surfaces of the gaming element are on top, and whether the player is touching the gaming element or not.

Another object of the present invention is to provide the gamin apparatus wherein the second logic circuit comprising a unique counter and a unique programmable ID number for facilitating said computing element for identifying the surface of non-conductive casing interacted by the player.

The board game includes but is not limited to chess, scrabble, draughts, snakes and ladders, chutes and ladders, Ludo, monopoly, or any other playsets that has a specific set of instructions that the players must follow in order to play the game. The gaming element includes but is not limited to dice, action figures, tokens, chess pieces, tiles, pawns, bits or any other game piece which may be used to play any game on or with a gaming board.

The computing element as specified in the claims may be a micro controller, a microprocessor or any other logic circuit which may perform all the various functions that are desired to be performed by the computing element as specified in the claims.

A dice as specified in the claims may be defined as a relatively small and throwable or non-throwable object with multiple resting positions, used for a generating random or desired position out of its multiple resting positions. The surface of the dice may be used to represent different numbers, alphabets, symbols, trademarks or strings of words in any visual way possible. Though conventionally a cube is with six surfaces, the dice may even be constructed with any number of surfaces, ranging from a tetrahedron to icosahedrons with four to twenty surfaces respectively, or even more.

BRIEF DESCRIPTION OF THE DRAWINGS

The features of the present invention, that are believed to be novel, have been particularly set forth in the appended claims. The invention, along with the objects and their advantages thereof can be better understood in reference to the following description, taken in conjunction with the accompanying drawings, in which like reference numbers identify like elements, and in which:

DETAILED DESCRIPTION OF THE DRAWINGS

While the specification concludes with claims defining the features of the invention, a method and a gaming apparatus for interacting with at least one player for playing a game will be better understood from a consideration of the following description in conjunction with the figures, in which every major element has been given a reference number. As required, the detailed embodiments of the present invention have been included herein. However, it must be understood that the disclosed embodiments are merely exemplary of the invention, which may be embodied in various forms. Therefore, the structural and functional details that have been disclosed should not be interpreted as limiting. They must merely be taken as the basis for the claims and as a representative basis for teaching one skilled in the specific domain to variously employ the present invention in virtually any appropriately detailed structure. Further, the terms, phrases and examples used herein are not intended to be limiting, but are rather are intended to provide an understandable description of the invention.

Figure 1:
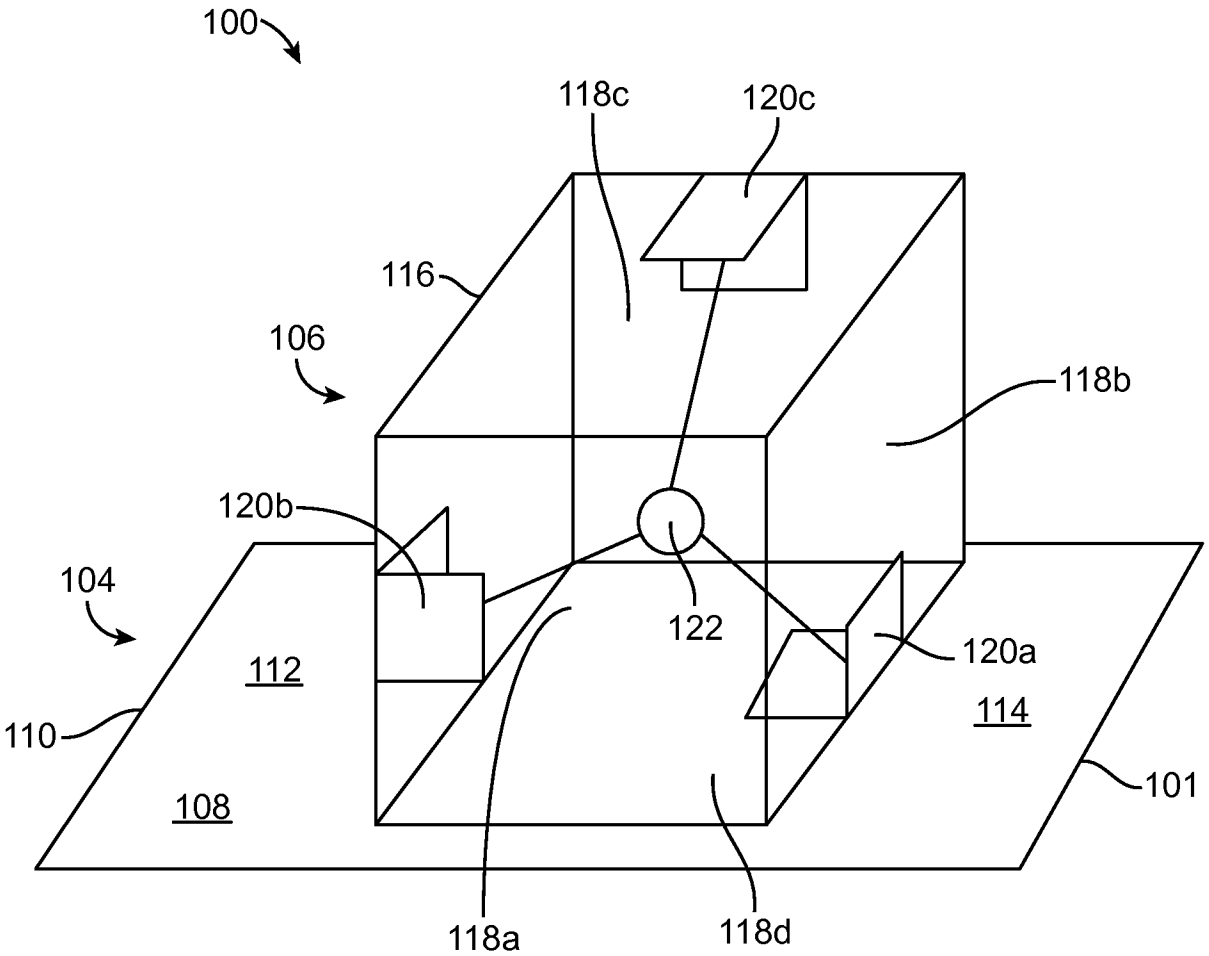
FIG. 1 illustrates a block diagram of the gaming apparatus connected to a DC source 101 for interacting with at least one player for playing a game, in accordance with a preferred embodiment of the present invention.

FIG. 1 illustrates a block diagram of the gaming apparatus 100 connected to a DC source 101 for interacting with at least one player 102 for playing a game. The gaming apparatus 100 includes a gaming surface 104 and at least one playing element 106 for interacting with at least one player 102 and the gaming surface 104.

The gaming surface 104 includes a generator 108 receives power from a DC source 101 for generating AC power of fixed frequency, a conducting surface 110 receives the AC power generated from the generator 108, a converter 112 coupling with the conducting surface 110 for accepting AC power from the generator 108 to generate a DC power, and a computing element 114 utilizing the DC power supplied by the converter 112 and the frequency supplied by the generator 108. The computing element 114 further stores the instruction set of the game.

The playing element 106 includes a non-conductive casing 116 having one or more surfaces 118 such as 118*a*, 118*b* and 118*c* is placed on the conducting surface 110, and one or more electrodes 120 such as 120*a*, 120*b* and 120*c* are attached to each surface of the non-conductive casing 116 for receiving alternating electric field from the conducting surface 110. In a preferred embodiment of the present invention, the alternating electric field is received by the one or more electrodes 120 through capacitive coupling with the conducting surface 110.

The one or more electrodes 120 transfer the AC power. In a preferred embodiment of the present invention, the non-conductive casing 116 is a cube with six surfaces. Examples of the shape of non-conductive casing 116 may include tiles, cards, action figures, tokens, chess pieces, pawns, bits or any other game piece. However, it will be readily apparent to those skilled in the art that various configuration of non-conductive casing 116 may be used without deviating from the scope of the present invention.

The playing element 106 further includes one or more pulse generators (not shown in FIG. 1) define the orientation of each surface 118 of non-conductive casing 116; a first logic circuit (not shown in FIG. 1) receives information from the one or more pulse generators (not shown in FIG. 1) and releases a first signal; a second logic circuit (not shown in FIG. 1) receives first signal and send the information to the converter 112 for decoding the information and then further the decoded information is send to the computing element 114, wherein the computing element 114 releases a second signal.

The playing element 106 further includes one or more light sources 122 connected to each of one or more electrodes 120 for responding to the second signal released by the computing element 114 via the second logic circuit (not shown in FIG. 1), and rectifiers (not shown in FIG. 1) to convert the AC power into DC power in order to operate said pulse generators, said first and second logic circuit, and said one or more light sources.

In a preferred embodiment of the present invention, the first electrode 120*a* is attached to two adjacent sides of surface such as 118*d* and 118*b*. The computing element 114 receives information related to orientation of non-conductive casing 116 from the second logic circuit (not shown in FIG. 1) and controls the one or more light sources 120 as per the game instructions.

In a preferred embodiment of the present invention, the one or more light sources 122 are either on or off as per the signal sent from the computing element 114. In a preferred embodiment of the computing element 114 is a micro-controller and one or more light sources 122 are LED. However, it will be readily apparent to those skilled in the art that various other forms of computing element 114 and light sources 122 may also be used without deviating from the scope of the present invention. The one or more pulse generators, second logic circuit, and rectifiers are explained in detailed in conjunction with FIG. 2 and FIG. 3 of the present invention.

Figure 2:
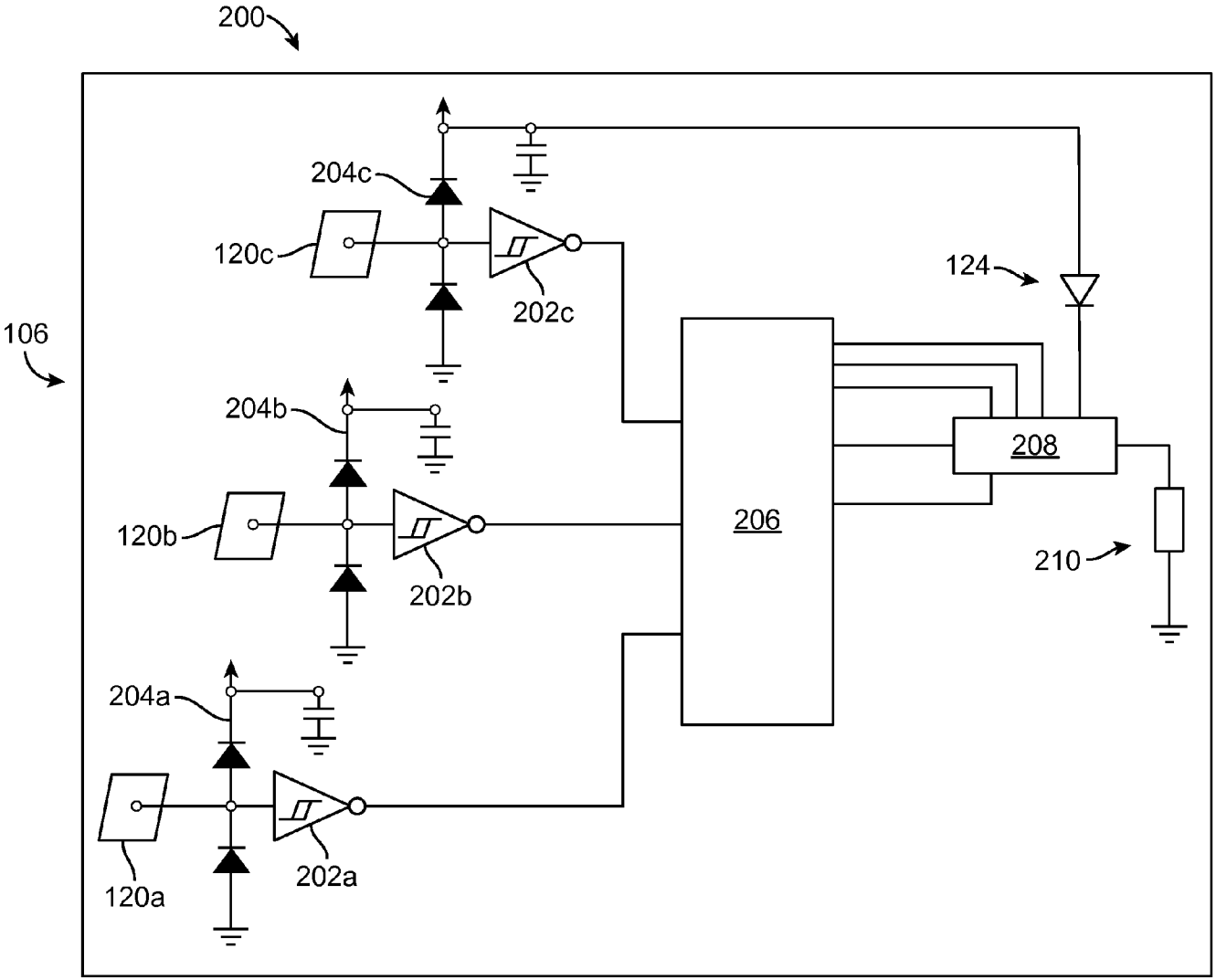
FIG. 2 illustrates a circuit diagram of the playing item in accordance with a preferred embodiment of the present invention.

FIG. 2 illustrates a circuit diagram 200 of the playing item 106 in accordance with a preferred embodiment of the present invention. At least one of the one or more electrodes 120 such as 120*a*, 120*b* and 120*c* is attached to at least one of the one or more pulse generators 202, such as 202*a*, 202*b* and 202*c* through at least one of the one or more rectifiers 204 such as 204*a*, 204*b* and 204*c*, respectively. The electrode 120*a* is attached to the surface 118*b* and 118*d*, wherein the surface 118*d* is in contact with the conducting surface 110. The electrode 120*b* corresponds to the surfaces of non-conductive casing 116 which are neither in contact with the player and nor the conducting surface. The electrode 120*c* corresponds to the sides of non-conductive casing 116 that are touched by the player and far from the conductive surface 110.

The one or more pulse generators 202, such as 202*a*, 202*b* and 202*c* receives the AC power from the electrodes 120 generates clock pulses of different clock cycles for identifying the different surfaces of non-conductive casing (not shown in FIG. 2). In a preferred embodiment of the present invention, the one or more pulse generators 202 are schmitt trigger. However, it will be readily apparent to those skilled in the art that various other pulse generators 202 may also be used without deviating from the scope of the present invention.

The first logic circuit 206 receives the information related to the orientation of each surface of non-conductive casing (not shown in FIG. 2) and further releases a first signal for the second logic circuit 208. The first logic circuit 208 counts until a defined time slot and divide the communication carrier clock from the master clock. The output of the first logic circuit is given as input into the second logic circuit 208. The second logic circuit 208 modulates the electric field with the input data by switching the load.

Examples of the first logic circuit 206 includes but not limited to counter, divider; and examples of the second logic circuit includes but not limited to demultiplexer and switches. The clock signals are explained in detail in conjunction with FIG. 3 of the present invention. In another preferred embodiment of the present invention, the playing element includes a communication load 210 connected to second logic circuit 208 for changing the impedance of the circuit with data modulated carrier frequency detectable outside the circuit.

The one or more rectifiers 204 such as 204*a*, 204*b* and 204*c* converts the AC power into DC power in order to operate the pulse generators 202, the first logic circuit 206 and the second logic circuit 208, and the one or more light sources (not shown in FIG. 2). Examples of the one or more rectifiers 204 include but not limited to bridge rectifiers, half-wave rectifiers, full-wave rectifiers etc. However, it will be readily apparent to those skilled in the art that various other forms of rectifiers 204 may be used without deviating from the scope of the present invention.

In another embodiment of the present invention, the second logic circuit 208 comprises a unique counter and a unique programmable ID number for facilitating the computing element (not shown in FIG. 2) for identifying the surface of non-conductive casing (not shown in FIG. 2) interacted by the player. Examples of unique counter and a unique programmable ID number include but not limited to digital numbers, binary or hexadecimal digits, alpha-numeric characters etc. It will be readily apparent to those skilled in the art that various other forms of counter and unique programmable ID number may be used without deviating from the scope of the present invention.

In an exemplary embodiment, two players touch two different playing elements, in order to detect which of the surface of which playing element is touched by which player is determined by the computing element by identifying the unique counter and unique programmable ID number. In another preferred embodiment of the present invention, the electronic circuitry of the playing item 106 may be integrated into the one or more light sources.

Figure 3:
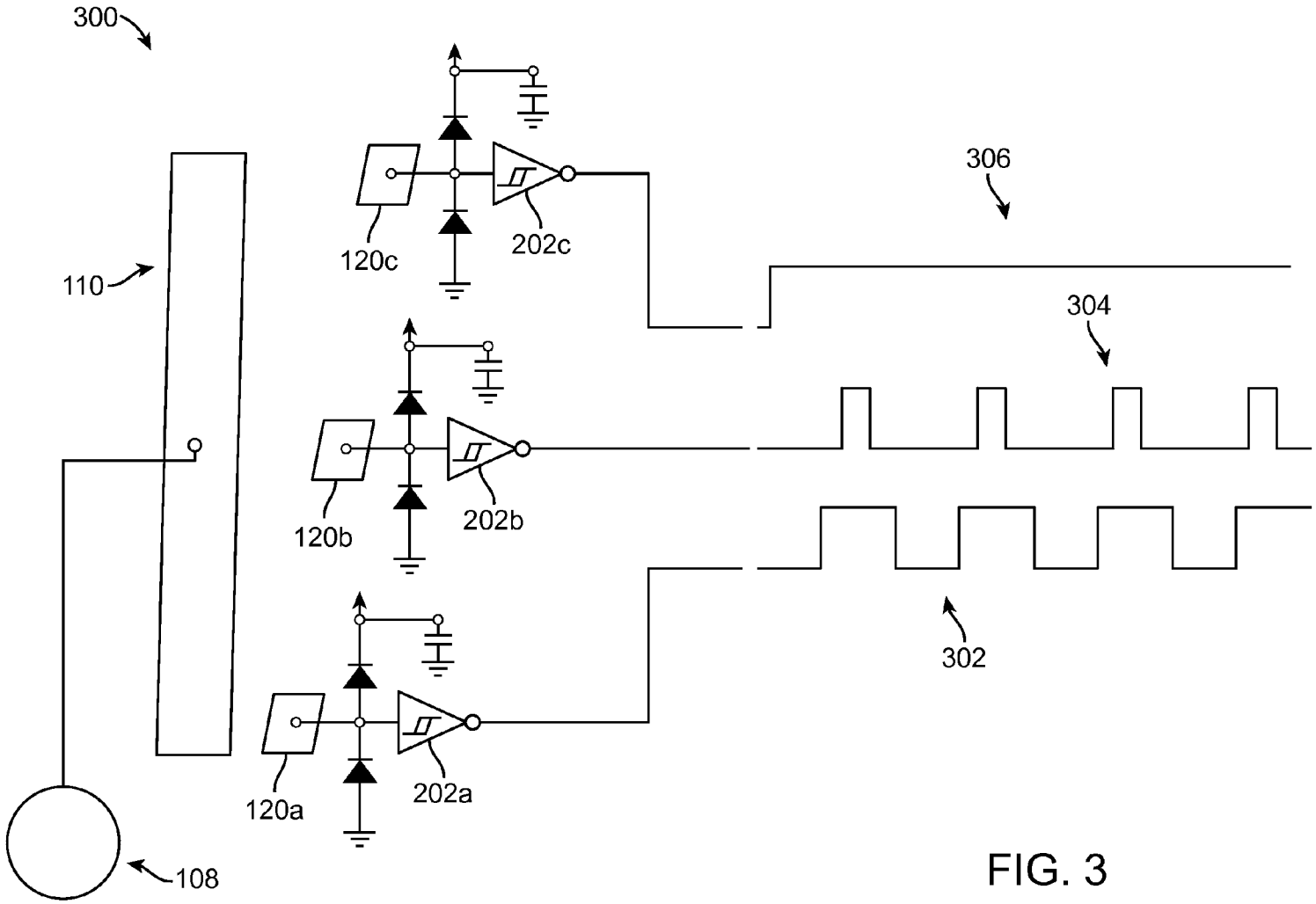
FIG. 3 illustrates the circuit diagram of the gaming apparatus showing the clock signals when no player is interacting with the playing item, in accordance with an exemplary embodiment of the present invention.

FIG. 3 illustrates the circuit diagram 300 of the gaming apparatus showing the clock signals when no player is interacting with the playing item, in a preferred embodiment of the present invention. The electrode 120*a* is nearest, the electrode 120*b* is in middle and the electrode 120*c* is farthest from the conducting surface 110. The pulse generator 202*a* connected to the electrode 120*a* produces a master clock 302 that enters as system clock in the first logic circuit (not shown in FIG. 3). The master clock 302 corresponds to the fixed frequency AC current generated by the generator 108.

The pulse generator 202*b* is connected to the electrode 120*b* facilitates the second logic circuit (not shown in FIG. 3) by producing second clock signals 304 to determine which of the surface of non-conductive casing (not shown in FIG. 3) is on top. In a preferred embodiment, wherein the non-conductive casing is a cube, the three electrodes 120 act in seven combinations such as showing the six cube surfaces and the player-touch. The changes in clock signal with interaction of player-touches are explained in detail in conjunction with FIG. 4 of the present invention.

The pulse generator 202*c* is connected to the electrode 120*c* produces the third clock signal 306 which is the untouched signal as it is not touched by the player. Thus, the third clock signal 306 corresponds to a high value that is given by the pulse generator 202*c* and has no interaction from the conducting surface 110 and the player.

Figure 4:
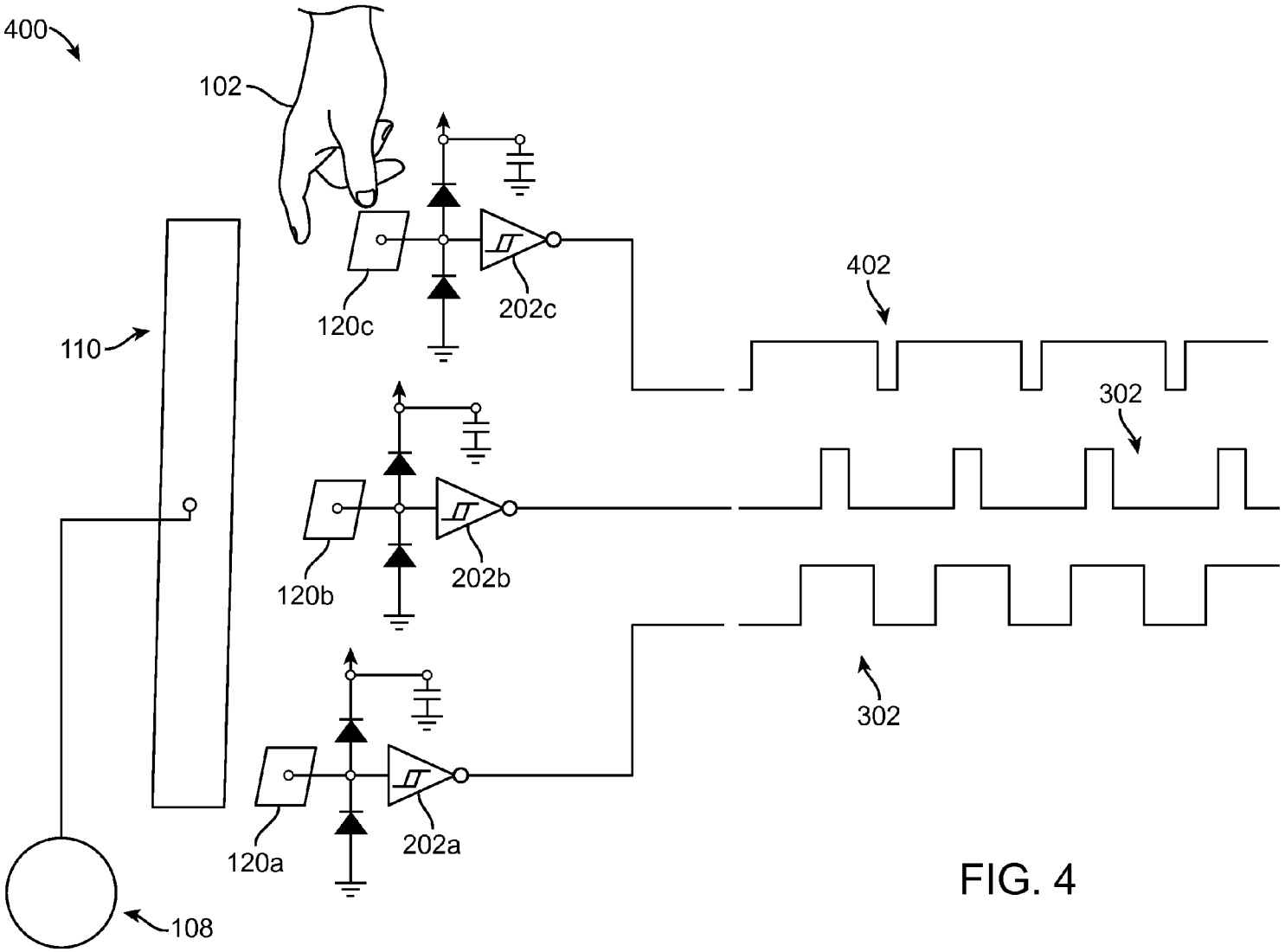
FIG. 4 illustrates a circuit diagram 400 of the gaming apparatus showing the clock signals on interaction with the player 102, in accordance with an exemplary embodiment of the present invention.

FIG. 4 illustrates a circuit diagram 400 of the gaming apparatus showing the clock signals on interaction with the player 102. The player 102 touches the top surface of non-conductive casing being in contact with the electrode 120*c*. The touch of the player 102 results in release of the fourth clock signal 402 to inform the first logic circuit (not shown in FIG. 4) about the surface of the non-conductive casing (not shown in FIG. 4) being in contact with the player 102. The first logic circuit (not shown in FIG. 4) determines the touched surface from the width of the fourth clock cycle 402.

Figure 5:
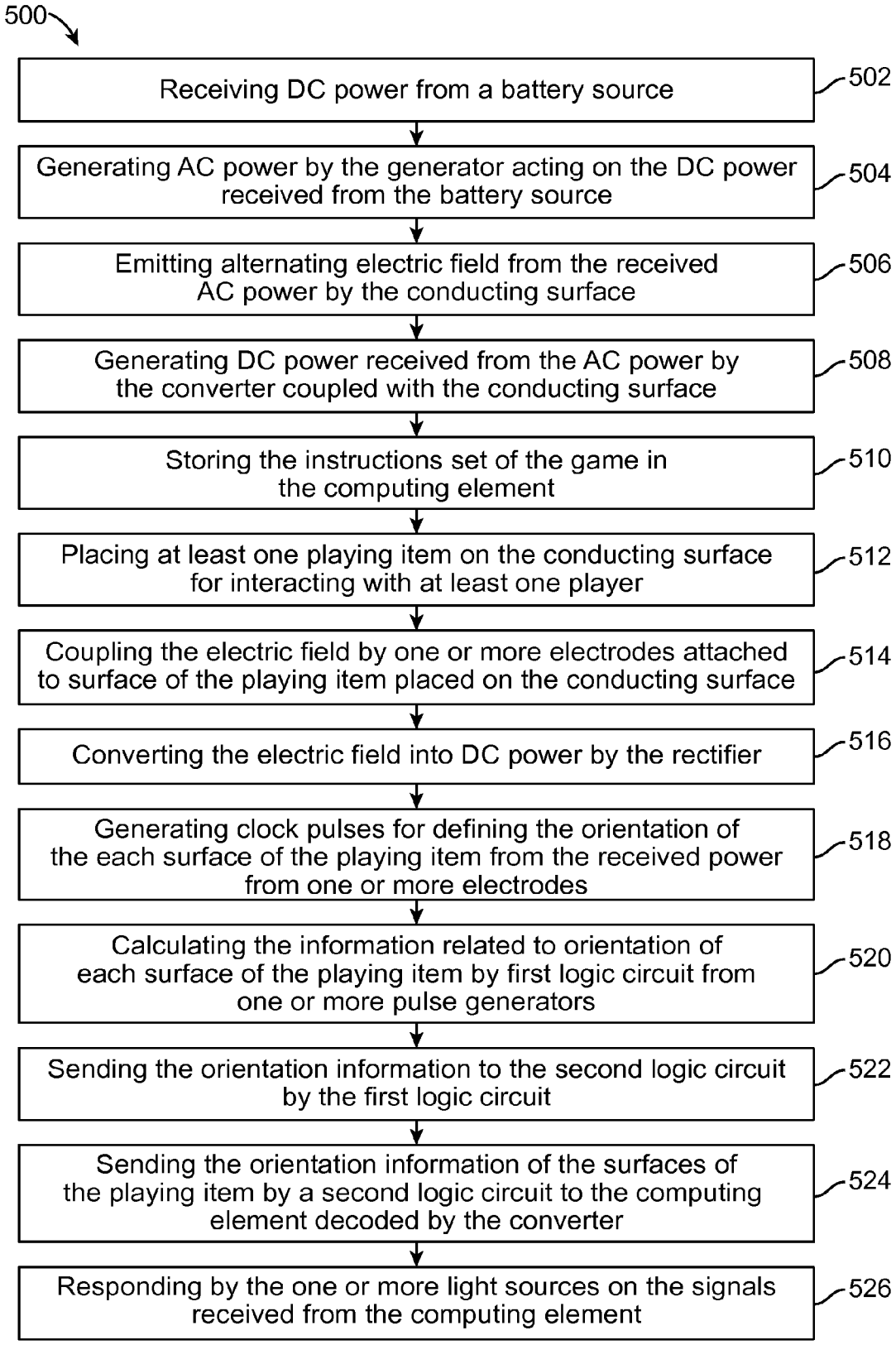
FIG. 5 illustrates a flowchart of a method for facilitating interactions and communications with at least one player, in accordance with a preferred embodiment of the present invention.

FIG. 5 illustrates a flowchart of a method 500 for facilitating interactions and communications with at least one player, in accordance with a preferred embodiment of the present invention. The method 500 initiates with a step 502 of receiving DC power from a battery source and then followed by a step 502 of generating AC power by the generator acting on the DC power received from the battery source. The step 502 and the step 504 are explained in detail in conjunction with FIG. 1 of the present invention.

The step 504 is then followed by a step 506 of emitting alternating electric field from the received AC power by the conducting surface and then followed by a step 508 of generating DC power received from the AC power by the converter coupled with the conducting surface. The step 506 and the step 508 are explained in detail in conjunction with FIG. 1 of the present invention.

The step 508 is then followed by a step 510 of storing the instructions set of the game in the computing element and the step 510 is then followed by a step 512 of placing at least one playing item on the conducting surface for interacting with at least one player. The step 510 and the step 512 are explained in detail in conjunction with FIG. 1 of the present invention.

The step 512 is then followed by a step 514 of coupling the electric field from one or more electrodes attached to surface of the playing item placed on the conducting surface. The step 514 is explained in detail in conjunction with FIG. 1 and FIG. 2 of the present invention. The step 514 is then followed by a step 516 of converting the electric field into DC power by the rectifier. The step 516 is explained in detail in conjunction with FIG. 1 and FIG. 2 of the present invention.

The step 516 is then followed by a step 518 of generating clock pulses for defining the orientation of the each surface of the playing item from the received power from one or more electrodes. The step 518 is explained in detail in conjunction with FIG. 1, FIG. 3 and FIG. 4 of the present invention. The step 518 is then followed by a step 520 of calculating the information related to orientation of each surface of the playing item by first logic circuit from one or more pulse generators and the step 520 is then followed by a step 522 of sending the orientation information to the second logic circuit by the first logic circuit. The step 518 and 520 are explained in detail in conjunction with FIG. 1 to FIG. 4 of the present invention.

The step 522 is then followed by a step 524 of sending the orientation information of the surfaces of the playing item by a second logic circuit to the computing element decoded by the converter and the step 524 is then followed by a step 526 of responding by the one or more light sources on the signals received from the computing element. The step 524 and the step 526 are explained in detail in conjunction with FIG. 1 and FIG. 2 of the present invention.

The present invention offers various advantages such as bringing a battery-free playing item which increases a certain level of interest among the players. Play items are made smaller, and are easier to develop, because they do not need to be opened for battery replacement. Further, glowing play items with the absence of chargers and plugs makes it more interactive for the children to have a keen interest in board games.

There has thus been shown and described a gaming apparatus which fulfills all the objects and advantages sought therefore. Many changes, modifications, variations and other uses and applications of the subject invention will, however, become apparent to those skilled in the art after considering this specification and the accompanying drawings, which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A gaming apparatus comprising:

a DC source;

a game board including:

(a) a generator configured to: (i) receive power from the DC source; and (ii) generate an AC power having a fixed frequency;

(b) a conducting surface configured to: (i) receive the AC power; and (ii) emit an alternating electric field;

(c) a converter coupled with the conducting surface, the converter being configured to: (i) accept the AC power from the generator; and (ii) generate a DC power; and (d) a computing element configured to: (i) use the DC power and the fixed frequency; and (ii) store an instruction set of a game; and a playing element configured to interact with a player and the game board, said playing element including:

(a) a non-conductive casing having a surface placed on the conducting surface;

(b) an electrode attached to the surface of the non-conductive casing, the electrode configured to: (i) receive the alternating electric field from the conducting surface; and (ii) transfer the AC power;

(c) a pulse generator connected to the electrode, the pulse generator configured to: (i) receive the AC power from the electrode; (ii) generate clock pulses to define an orientation of the surface of the non-conductive casing;

(d) a first logic circuit connected to the pulse generator, the first logic circuit configured to: (i) receive information related to the orientation of the surface of the non-conductive casing; and (ii) release a first signal;

(e) a second logic circuit configured to: (i) receive the first signal from the first logic circuit; (ii) transmit the first signal to the computing element through the converter for data decoding, wherein the computing element generates a second signal;

(f) a light source connected to the electrode, the light source configured to: (i) receive the AC power from the electrode; (ii) respond to interaction with the player; and (iii) respond to the second signal generated by the computing element via the second logic circuit; and (g) converter circuitry configured to: (i) convert the AC power into second DC power; and (ii) use the second DC power to operate the pulse generator, the first logic circuit, the second logic circuit, and the light source.

2. The gaming apparatus of claim 1, wherein:

the second logic circuit includes a counter and a unique programmable ID number; and the computing element is configured to identify the surface of the non-conducting casing based on the counter and the unique programmable ID number.

3. The gaming apparatus of claim 1, wherein the DC source comprises a battery.

4. The gaming apparatus of claim 1, wherein the playing element further includes a communication load connected to the second logic circuit for changing the impedance of the second logic circuit with data modulated carrier frequency detectable outside the second logic circuit.

5. A gaming apparatus comprising:

a game board including:

(a) a battery source configured to generate first DC power;

(b) a generator configured to: (i) receive power from a DC source; and (ii) generate an AC power having a fixed frequency;

(c) a conducting surface configured to: (i) receive the AC power; and (ii) emit an alternating electric field;

(d) a converter coupled with the conducting surface, the converter being configured to: (i) accept the AC power; and (ii) generate second DC power;

(e) a computing element configured to: (i) use the second DC power and the fixed frequency; and (ii) store an instruction set of a game; and a playing element configured to interact with a player and the game board, the playing element including:

(a) a non-conductive cube casing having six surfaces, wherein at least one of the six surfaces is placed on the conducting surface;

(b) at least three electrodes attached to at least one of said six surfaces, the at least three electrodes configured to: (i) receive the alternating electric field from the conducting surface; and (ii) transfer the AC power;

(c) at least three pulse generators, wherein at least one of the pulse generators: (i) is connected to each of the at least three electrodes to receive the AC power; and (ii) is configured to generate clock pulses to define an orientation of the six surfaces of the non-conductive casing;

(d) a first logic circuit connected to the at least three pulse generators to receive information related to the orientation of the six surfaces of the non-conductive cube casing, the first logic circuit being configured to release a first signal;

(e) a second logic circuit configured to: (i) receive the first signal from the first logic circuit; (ii) transmit the first signal to the computing element through said converter for data decoding, wherein the second logic circuit includes a counter and a unique programmable ID number, wherein the computing element is configured to: (i) identify a first surface of the non-conductive cube based on the counter and the unique programmable ID number, wherein the first surface is interacted by the player and wherein the six surfaces includes the first surface; and (ii) generate a second signal;

(f) a light source connected to each of the at least three electrodes to receive the AC power, said light source configured to: (i) respond to interaction with the player; and (ii) respond to the second signal generated by the computing element via the second logic circuit; and (g) a converter circuitry configured to convert the AC power into third DC power to operate the at least three pulse generators, the first logic circuit, the second logic circuit, and the light source.

6. The gaming apparatus according to claim 5 wherein said playing element further comprising a communication load connected to the second logic circuit for changing the impedance of the second logic circuit with data modulated carrier frequency detectable outside the second logic circuit.

7. A method for facilitating interactions and communications of a playing item and a player of a game with a game board, said method comprising:

providing a DC source;

providing a game board having a generator, a conducting surface, a converter coupled with the conducting surface, and a computing element;

receiving, via the generator power from the DC source;

generating, via the generator, an AC power having a fixed frequency;

receiving, via the conducting surface, the AC power;

emitting, via the conducting surface, an alternating electric field;

accepting, via the converter, the AC power from the generator;

generating, via the converter, a DC power;

using, via the computing element, the DC power and the fixed frequency;

storing, via the computing element, an instruction set of the game;

providing a playing element having: (i) a non-conductive casing having a surface placed on the conducting surface; (ii) an electrode attached to the surface of the non-conductive casing; (iii) a pulse generator connected to the electrode; (iv) a first logic circuit connected to the pulse generator; (v) a second logic circuit; (vi) a light source connected to the electrode; and (vii) converter circuitry;

interacting, via the playing element, with the player and the game board;

receiving, via the electrode, the alternating electric field from the conducting surface;

transferring, via the electrode, the AC power;

receiving, via the pulse generator, the AC power from the electrode;

generating, via the pulse generator, clock pulses to define an orientation of the surface of the non-conductive casing;

receiving, via the first logic circuit, information related to the orientation of the surface of the non-conductive casing;

releasing, via the first logic circuit, a first signal;

receiving, via the second logic circuit, the first signal from the first logic circuit;

transmitting, via the second logic circuit, the first signal to the computing element through the converter for data decoding;

generating, via the computing element, a second signal;

receiving, via the light source, the AC power from the electrode;

responding, via the light source, to interaction with the player;

responding, via the light source, to the second signal generated by the computing element via the second logic circuit; and converting, via the converter circuitry, the AC power into second DC power;

using, via the converter circuitry, the second DC power to operate the pulse generator, the first logic circuit, the second logic circuit, and the light source.

* * * * *